United States Patent [19]

Glass

[11] 4,182,196

[45] Jan. 8, 1980

[54] THROTTLE CONTROL MECHANISM

[75] Inventor: Emmett F. Glass, Akron, Pa.

[73] Assignee: Sperry Rand Corporation, New Holland, Pa.

[21] Appl. No.: 888,445

[22] Filed: Mar. 20, 1978

Related U.S. Application Data

[63] Continuation of Ser. No. 641,416, Dec. 17, 1975, abandoned.

[51] Int. Cl.[2] ..... G05G 1/00; G05G 1/04

[52] U.S. Cl. ..... 74/491; 74/520

[58] Field of Search ..... 74/520, 513, 504, 516, 74/518, 522, 522.5, 481, 482, 491, 519, 523, 524; 123/98

[56] References Cited

U.S. PATENT DOCUMENTS

| | | | |
|---|---|---|---|
| 3,040,596 | 6/1962 | Du Shane et al. | 74/482 |
| 3,164,031 | 1/1965 | Rubissow | 74/520 X |
| 3,492,889 | 2/1970 | Hauff | 74/491 X |

*Primary Examiner*—C. J. Husar
*Assistant Examiner*—Frank McKenzie
*Attorney, Agent, or Firm*—Ralph D'Alessandro; Frank A. Seemar; John B. Mitchell

[57] ABSTRACT

A mechanical throttle control mechanism is provided for the remote control of an internal combustion engine. The mechanism comprises a speed selector arm movable between first and second limit positions, a friction lock operably associated with the speed selector arm and an arrangement of links connecting the speed selector arm to the throttle lever of the engine. The links of the mechanism are so positioned to cause a decreasing moment arm on the speed selector arm as the speed selector arm is moved from its first position toward its second position which respectively corresponds to the shut-off and full-throttle positions of the throttle lever. This arrangement reduces the need experienced heretofore for high friction disc pressure to hold the speed selector arm in a desired position between its limit positions, resulting in less disc wear and less frequent friction spring adjustment. At its second position, the selector arm is in an over-centered position which eliminates the rotational load on the friction disc and prevents the speed selector arm from slipping toward its first position.

6 Claims, 3 Drawing Figures

THROTTLE CONTROL MECHANISM

This is a continuation, of application Ser. No. 641,416, filed Dec. 17, 1975 now abandoned.

BACKGROUND OF THE INVENTION

This invention relates to a control mechanism and is particularly directed to an improved throttle control mechanism for remotely controlling the position of the throttle lever on an internal combustion engine.

It is common practice today to control the throttle lever of an internal combustion engine remotely. Generally, the remote controls include a selector handle positioned in proximity to the operator's station with linkage extending to the engine. The selector handle, being movable between limit positions corresponding to the shut-off and full-throttle positions of the throttle lever, is operably associated with a releasable lock for holding the handle in desired intermediate positions between its limit positions. The throttle lever is usually biased toward its shut-off position by some means such as a governor spring.

A typical example of such a throttle control mechanism is one having a selector handle rotatably mounted on the frame of a vehicle with a cable connected to the throttle lever. Associated with the handle is an adjustable friction lock having a friction disc or discs which are resiliently urged against the selector handle to offset the governor spring force and thereby retain the selector handle in the desired position. Such control mechanism works satisfactory but has certain shortcomings. The larger the governor spring force, the larger the offsetting frictional force (disc pressure) needed for retaining the handle in a desired position, and thus the operator must exert a greater force to move the selector handle. The high friction disc pressure required heretofore results in frequent friction spring adjustment and excessive disc wear which is costly to repair.

SUMMARY OF THE INVENTION

The present invention sets forth a unique throttle control mechanism which is simple in construction and inexpensive to manufacture. The improved mechanism reduces the need experienced heretofore for high friction disc pressure to hold the selector handle in a desired position thus resulting in less disc wear and less frequent friction spring adjustment. While the invention is set forth in application to a loader of the self-propelled type, it will be readily apparent that it is suitable for use on any internal combustion engine that is remotely controlled.

Accordingly, the present invention sets forth an improved throttle control mechanism for a vehicle driven by an internal combustion engine having a throttle lever movable over a range between shut-off and full-throttle positions. The throttle control mechanism includes a throttle control assembly rotatably mounted on the sidewall of the vehicle adjacent the operator's station, with means extending rearwardly therefrom towards the engine for connecting a selector arm of the throttle control assembly to the throttle lever of the engine such that the throttle lever is pivoted as the selector arm is rotated. The throttle control assembly and the connecting means being positioned such that the moment on the selector arm increases at a slower rate than the moment on the throttle lever under conditions where the selector arm is pivoted from the shut-off to the full-throttle positions.

The throttle control mechanism further includes a frictional lock operably associated with the lower portion of the selector arm to retain the selector arm in any selected intermediate position between its limit position.

The improved throttle control mechanism further includes an over centering position which positively holds the selector arm in the full throttle position.

These and other advantages and attainments of the present invention will become apparent to those skilled in the art upon reading of the following detailed description when taken in conjunction with the drawings wherein there is shown and described an illustrative embodiment of the invention.

BRIEF DESCRIPTION OF THE DRAWINGS

In the course of the following detailed description, reference will be frequently made to the attached drawings in which.

DETAILED DESCRIPTION OF THE INVENTION

In the following description, right hand and left hand references are determined by standing at the rear of the machine facing in a direction of forward travel. Also, in the following description, it is to be understood that such terms "forward," "rearward," "left," "upwardly," etc., are words of convenience and are not to be construed as limiting terms.

IN GENERAL

Figure 1:
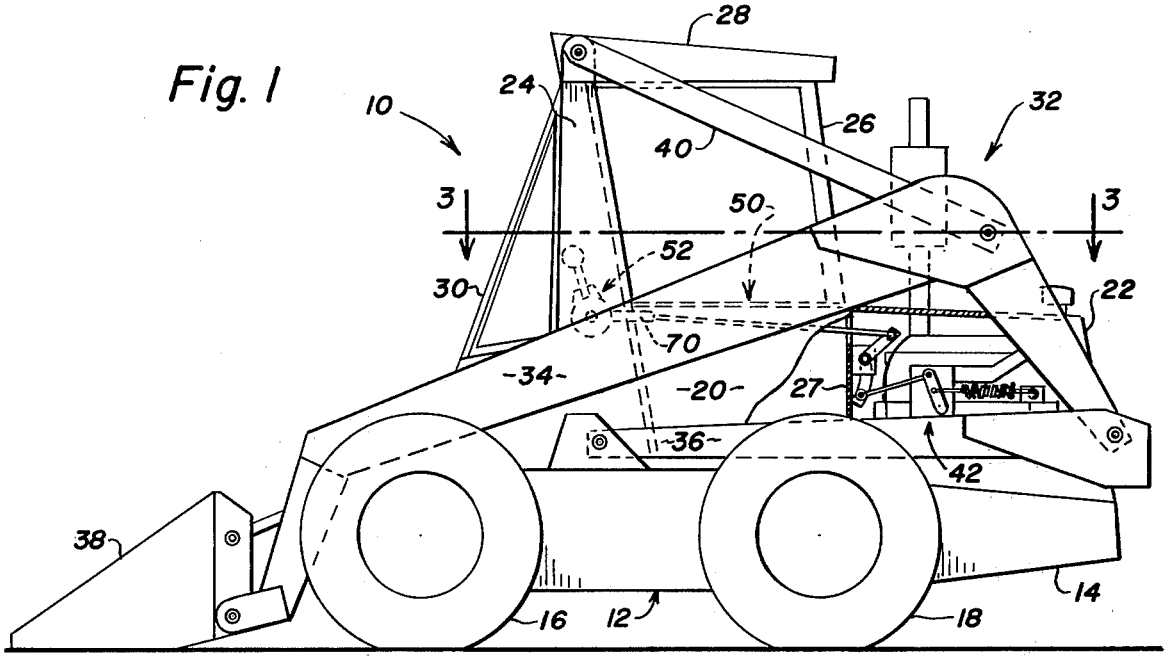
FIG. 1 is a side view of a loader, with portions omitted, which incorporates the throttle control mechanism of the present invention.

Referring now to the drawings, and particularly to FIG. 1, there is shown a self-propelled loader, being indicated generally by the numeral 10, which incorporates the preferred embodiment of the present invention. While the invention is illustrated in a loader, it should be understood that it may be readily adapted for use with other types of vehicles or machines as desired.

Only the left hand side of the loader 10 is shown in FIG. 1, the basic structural components being identical on each side of the machine. The loader 10 is provided with a main body frame or chassis 12 which includes a pair of laterally-spaced elongated drive housings 14, the drive housings being enclosed structures containing mechanisms for driving pairs of front and rear rotatatively mounted drive wheels 16,18. The chassis 12 further includes a pair of laterally spaced sidewalls 20 and a rear engine compartment that supports an internal combustion engine 22. The associated drive components are not shown in this particular case because such is immaterial to the present invention. For a working knowledge of the drive system, reference is made to U.S. Pat. No. 3,810,517 granted to Hurlburt et al on May 14, 1974, assigned to present assignee.

A cab or protective enclosure extends over a central portion of the main body frame or chassis 12 and generally defines an operator's station. The cab is made up of a pair of laterally spaced vertically upstanding front support posts 24 which extend from the main body frame 12. Spaced rearwardly of the front support posts 24 are a corresponding pair of rear support posts 26, with rear panel 27 extending therebetween to protect the operator from the engine. Mounted across the top of the front and rear posts 24 and 26 is a roof structure 28. The operator's station as defined by the protective cab structure houses the necessary controls for controlling the various operations of the loader. Disposed forwardly of the cab structure and adjacent the front support posts 24 are a pair of open A-frame panels 30.

The present loader 10 further includes a boom structure indicated generally by numeral 32 in FIG. 1. The boom structure 32 is basically comprised of a pair of corresponding upper boom arms 34 and a pair of corresponding lower boom arms 36. The lower boom arms 36 are pivotally secured to respective sides of the loader 10 and extend generally rearwardly therefrom. Each upper boom arm 34 has one end extremity pivotally connected to the rearmost extremity of a lower boom arm 36 and extends generally upwardly therefrom for a short distance and then bends generally forward and projects therefrom past the forwardmost portion of the loader 10. The front portion of the upper boom arms 34 is adapted to receive a material handling implement, which in the embodiment shown in the present application is a bucket 38.

To support the boom structure 32 and to provide additional guidance therefor, a pair of support links 40 are pivotally interconnected between an upper portion of the cab and a rear portion of the upper boom arms 34. As in most commercial heavy duty loaders, the boom structure is powered by hydraulics and in the present case a pair of hydraulic cylinders (not shown), one on each side of the loader being pivotally connected at its cylinder end to a side portion of the loader just above the pivotal connection of one of the lower boom arms 36. The rod portion of each of the cylinders is pivotally connected to a rear intermediate point on one of the upper boom arms 34. Although the boom structure has been described briefly, a more detailed appreciation and unified understanding of the boom structure can be gained from a study of U.S. Pat. No. 3,215,292 granted to L. M. Halls on Nov. 2, 1965, also assigned to present assignee.

Figure 2:
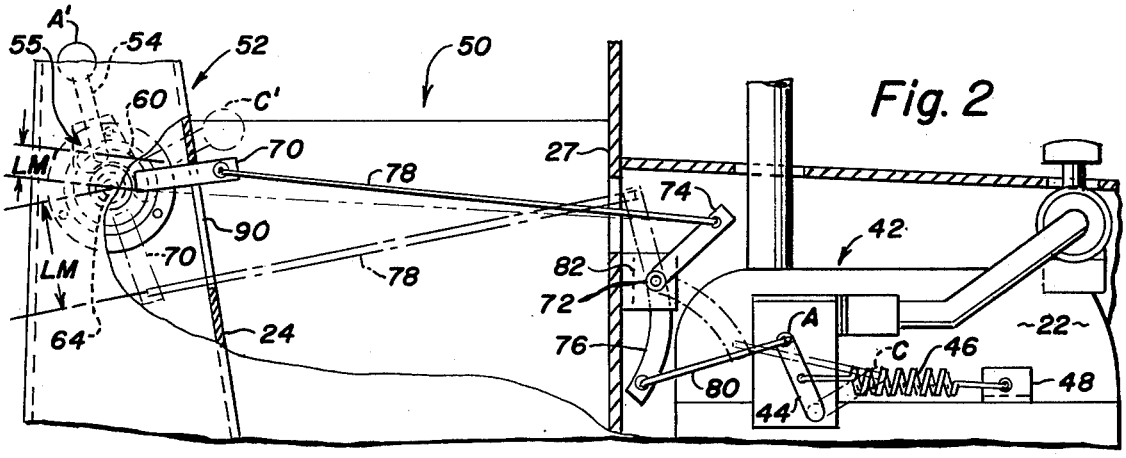
FIG. 2 is an enlarged fragmentary elevational view of the throttle control mechanism of FIG. 1, showing in dotted and solid lines the relative positions of the mechanism.

Conventional means for governing the output of engine 22 is generally designated by the numeral 42. Basically, such means includes a pivot arm or throttle lever 44 pivotally mounted on the left side of the engine 22 and a coil spring 46 which extends between and interconnects the throttle level 44 and a bracket 48 mounted on the frame 12 rearwardly of the throttle lever 44. The output of the engine is varied as the throttle lever 44 is pivoted over a range between full throttle and shut-off positions (respective positions A and C as shown in FIG. 2). The spring 46 biases or forces the throttle lever towards its shut-off position C as represented in dotted line form in FIG. 2. The force of the spring 46 increases as the throttle lever 44 is pivoted from its shut-off position towards the full throttle position, thereby increasing the moment on throttle lever 44.

Although, in the preferred embodiment only one type of engine and related output governing means is shown, it is obvious to those skilled in the art that there exists numerous other types of engines and associated governing means that can easily be substituted herefore. The improved throttle control mechanism is readily adapted for use on all types of engines which have some type of pivot arm or throttle lever that is movable between positions to vary the output of the engine.

IMPROVED THROTTLE CONTROL MECHANISM

Figure 3:
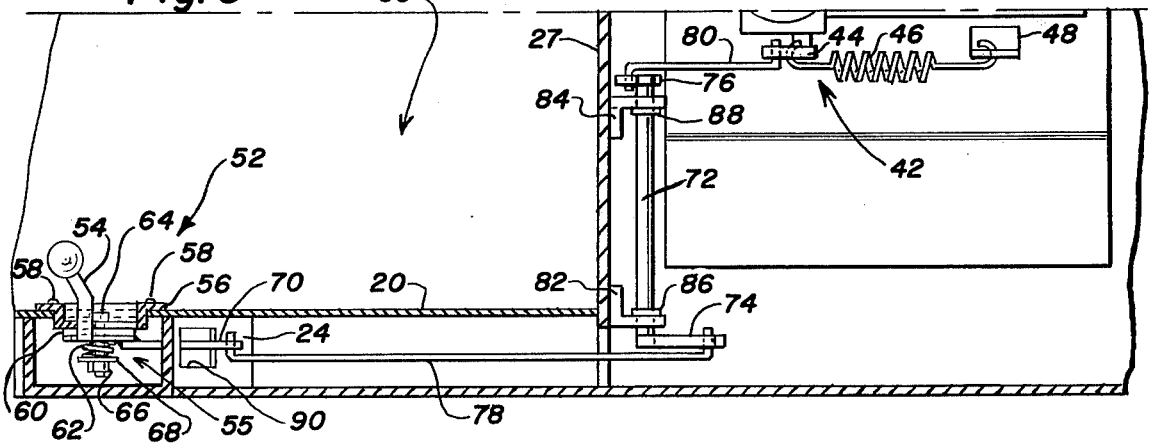
FIG. 3 is an enlarged fragmentary plan view taken along line 3—3 of FIG. 1.

The improved throttle control mechanism of the present invention is generally designated by the numeral 50 and is best seen in FIGS. 2 and 3. Although the general location of the improved mechanism is not new, the combination of the components and the relationship thereof are unique and achieve improved results over the throttle control mechanism known up to this time.

The control mechanism 50 comprises a control assembly 52, disposed adjacent the left side of the operator's station, with means extending rearwardly therefrom operably connected to the throttle lever 44 whereby the operator remotely controls the operation of the engine 22. The control assembly 52 contains a selector arm 54 having a lower portion with an integral handle extending upwardly therefrom. The selector arm 54 is movable between limit positions A', C' (position C' being shown in dotted lines in FIG. 2) corresponding respectively to positions A, C of throttle lever 44. The control assembly 52 further includes a friction lock 55 operably associated with the lower portion of the selector arm 54 for releasably holding the selector arm 54 in any desired angular position between its limit positions.

The selector control assembly 52 being transversely disposed between the inner and outer sidewalls of front left post 24 is mounted to a cover plate 56 which is secured to the inner sidewall of the post 24 by screws 58. Assembly 52 includes a friction disc 60 adjacent to and in contact with the coverplate, a selector arm 54 having a lower portion adjacent to and in contact with the friction disc and a coil spring 62 adjacent to and in contact with the lower portion of the selector arm. A bolt 64 extends through a hole in the cover plate 56 and through aligned holes in the disc 60 and the lower portion of selector arm 54 with a lock nut 66 and washer 68 on the inner end of the bolt to firmly maintain the assembly 52 in an operative position. Spring 62 being coiled around bolt 64, in a state of compression between the washer 68 and the lower portion of the selector arm 54, forces the latter against the friction disc 60 to frictionally hold the selector arm 54 in any selected immediate position between its limit positions A', C'. Tightening of lock nut 66 increases the frictional force on the selector arm 54.

The selector arm 54 is operably connected to the throttle lever 44 by an arrangement of links positioned such that, as the selector arm 54 is rotated from its shut-off position to its full-throttle position, the resulting moment on the selector arm 54 increases at a slower rate than the rate of increase of the moment on the throttle lever 44 being created by the increasing force of spring 46.

The arrangement of links basically comprises a radially outwardly extending lever 70 secured at one end to the lower portion of the selector arm 54, a cross link 72 transversely disposed adjacent rear panel 27 and having oppositely extending bars 74,76 secured to each of its ends, and a pair of connecting rods 78,80. The rod 78 pivotally connects the lever 70 to the bar 74 and rod 80 pivotally connects bar 76 to the throttle lever 44. The opposite ends of cross link 72 are respectively mounted on outwardly projecting legs of L-shaped brackets 82,84 and supported thereon for rotation within bushing 86,88. As the selector arm 54 is rotated in a counterclockwise direction from its limit position C', as viewed in FIG. 2, the lever 70 moves therewith in an arcuate path through aperture 90 provided in post 24 and rearwardly towards engine 22 until the selector arm 54 reaches its limit position A' wherein the lever 70 abuts the upper edge of the aperture 90.

The improved throttle control mechanism 50, of the present invention as incorporated in the loader 10, enables the operator to select any desired output of the engine 22 between full-throttle and shut-off positions. It is readily apparent from the foregoing discussion that the present invention has the advantage of being simple and easy to construct while performing a useful and worthwhile function in the loader. The arrangement of the components results in a improved throttle mechanism which is advantageous both economically and practically.

The aforementioned slower rate of increase in the moment on the selector arm 54 than the rate of increase of the moment on throttle lever 44 (as the arm 54 and lever 44 correspondingly rotate from their respective positions C'C to positions A',A) is due to the decreasing length of the moment arm on the selector arm 54 brought about by the above-described arrangement of links. The length of the moment arm on arm 54 at its limit position C' is represented by LM and at its limit position A' is represented by LM', as seen in FIG. 2. While the above-described arrangement of links is preferred, it is only exemplary and other suitable arrangements may be used to provide the function of decreasing the length of the moment arm on arm 54 as it is moved from its limit position C' to limit position A'.

Heretofore, the frictional force required to hold the selector arm 54 in any desired position had to be comparable to the biasing force imposed on throttle lever 44 by spring 46. The decrease in length of the moment arm on selector arm 54 as provided by the mechanism of the present invention decreases the resulting moment on arm 54 and thereby decreases the frictional force required to hold selector arm 54 in any desired position from that required heretofore. In effect, this improved throttle control mechanism 50 provides a mechanical advantage which is easily understood from FIG. 2. It can be seen that as the selector arm 54 rotates counterclockwise, the biasing force of spring 46 increases, increasing the moment on the throttle lever 44. Consequently, the resulting moment on the selector arm 54 increases as the moment on the throttle lever increases. However, due to the decreasing length of the moment arm on arm 54, the resulting moment on arm 54 increases at a slower rate and, therefore, the high frictional force required heretofore between the disc 60 and the arm 54 to hold the selector arm 54 in desired positions is eliminated, resulting in less disc wear and less frequent friction spring adjustment.

A further advantage of the mechanism 50 lies in the fact that the lever 70 is locked against post 24 in an over-centered position when arm 54 is at its limit position A' and when the lever 44 is at its full-throttle position. This over-center position positively maintains the selector arm 54 at its limit position A' and thus the throttle lever 44 at its full-throttle position when the spring 46 is exerting its greatest force tending to return lever 44 toward its shut-off position.

Thus, it can be appreciated, that an improved throttle control mechanism 50 has been provided for remotely controlling the operation of an engine. The mechanism allows the operator to easily move a selector arm to indefinite intermediate positions between its limit positions and to releasably hold the selector arm in any such intermediate position. The mechanism is easily maintained and eliminates troublesome and costly repairs experienced by the control mechanisms of the past.

The present invention, of course, may be carried out in other specific ways than those herein set forth without departing from the spirit and essential characteristics of the invention. The present embodiment is, therefore, to be considered in all respects as illustrative and not restrictive, and all changes coming within the meaning and equivalency range are intended to be embraced herein.

Having thus described the invention, what is claimed is:

1. An improved throttle control mechanism for a vehicle driven by an internal combustion engine having a throttle lever movable over a range between shut-off and full-throttle positions, said throttle control mechanism comprising:

(a) a control arm rotatably mounted about a pivot point on the frame of said vehicle for movement between first and second limit positions corresponding respectively to the shut-off and full-throttle positions of said throttle lever, said control arm including a pivotable radially extending lever, a frictional engaging portion and an integral handle extending from said portion for rotating said control arm;

(b) a friction lock operably associated with said frictional engaging portion to retain said control arm in any selected intermediate position between its limit positions;

(c) resilient means for biasing said throttle lever to the shut-off position; and (d) means pivotally interconnected between said frictional engaging portion, said radially extending lever and said throttle lever for moving the latter between respective positions as said control arm moves between corresponding positions, said interconnecting means including a connecting link fastened to said radially extending lever whereby at least a portion of said radially extending lever and at least a portion of said connecting link are raised from a first position below said pivot point of said control arm to a second position above said pivot point when the control arm is moved between said first and said second limit positions so that the resulting moment on said control arm increases at a slower rate than the rate of increase of the moment on said throttle lever thereby decreasing the frictional force required to counteract said resulting moment for retaining said control arm in a selected position.

2. An improved throttle control mechanism, as set forth in claim 1, wherein, said radially extending lever is secured to said frictional engaging portion of said control arm and is movable therewith, said radially extending lever projecting outwardly towards said throttle lever when said control arm is in the corresponding full throttle position.

3. An improved throttle control mechanism, as set forth in claim 2, wherein said radially extending lever is mounted to said friction engaging portion and is in abutting engagement with a portion of said frame when said control arm is in its second limited position.

4. An improved throttle control mechanism, as set forth in claim 3, wherein, said interconnecting means further comprises a second lever mounted on said frame in the direction of said radially extending lever.

5. An improved throttle control mechanism, as set forth in claim 4, wherein, said radially extending lever and said second lever are pivotally interconnected by said connecting link, said second lever being pivotally connected to said throttle lever by a second connecting link and a third pivotable radially extending lever in predetermined angular relationship to said second lever.

6. An improved throttle control mechanism as set forth in claim 5, wherein, said friction lock comprises a spring and a friction disc, the disc being forced against said frictional engaging position by said spring.

* * * * *